United States Patent [19]

Nissim

[11] Patent Number: 5,009,139

[45] Date of Patent: Apr. 23, 1991

[54] CHECK DESTRIPPER

[76] Inventor: Yosi Nissim, 23509 Spires St., West Hills, Calif. 91304

[21] Appl. No.: 332,525

[22] Filed: Mar. 31, 1989

[51] Int. Cl.[5] ..... B26D 1/22; B26D 5/22

[52] U.S. Cl. ..... 83/419; 83/430; 83/434; 83/436; 83/929; 83/734

[58] Field of Search ..... 83/102, 430, 431, 434, 83/436, 476, 912, 419, 929, 734

[56] References Cited

U.S. PATENT DOCUMENTS

| | | | |
|---|---|---|---|
| 2,216,108 | 10/1940 | Brockway | 83/430 |
| 3,301,116 | 1/1967 | Owen | 83/912 |
| 3,612,746 | 11/1971 | Womack | 83/430 |
| 3,964,359 | 6/1976 | Westover | 83/500 |
| 4,144,786 | 3/1979 | Beard et al. | 83/912 |

*Primary Examiner*—Hien H. Phan
*Attorney, Agent, or Firm*—Thomas I. Rozsa

[57] ABSTRACT

An apparatus for orienting a check which has attached to it a corroborating paper strip in a manner such that the check and the paper strip are aligned relative to a cutting station to permit the check and the attached strip to be automatically presented to the cutting knife in a precise location such that the knife can automatically cut the check at the location of the intersection of the check edge and the edge of the corroborating paper strip and thereafter separate the two and cause the detached check to be sent to one processing station while the detached corroborating paper strip is sent to a waste paper station.

3 Claims, 2 Drawing Sheets

Fig. 7.
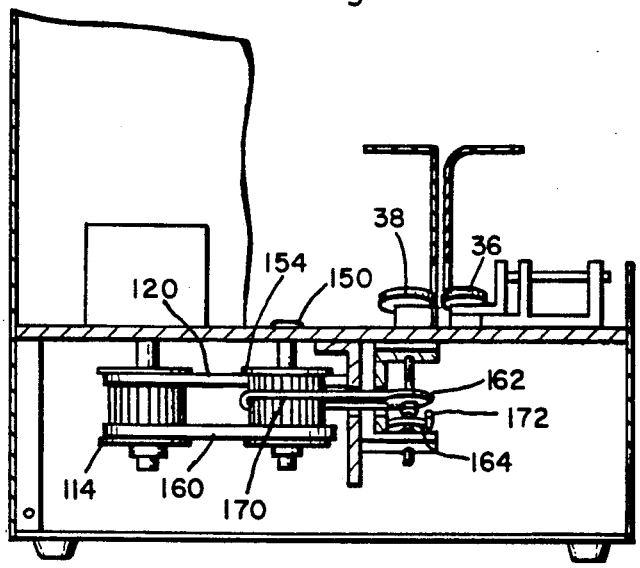
Fig. 6.
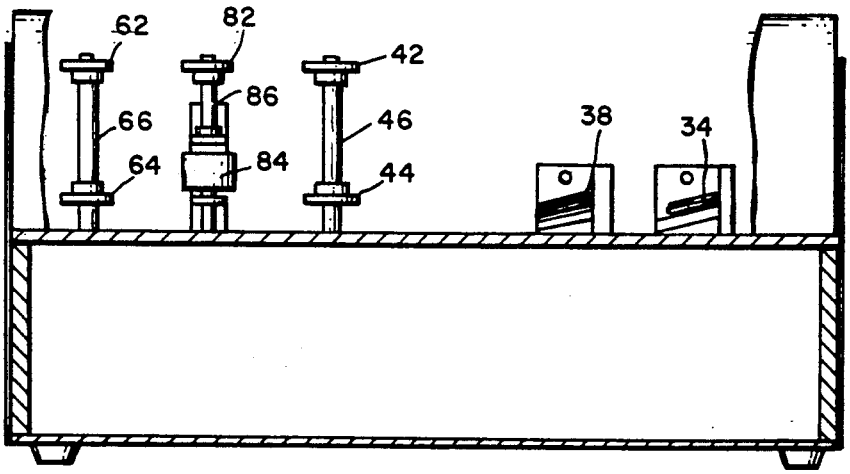
Fig. 9.
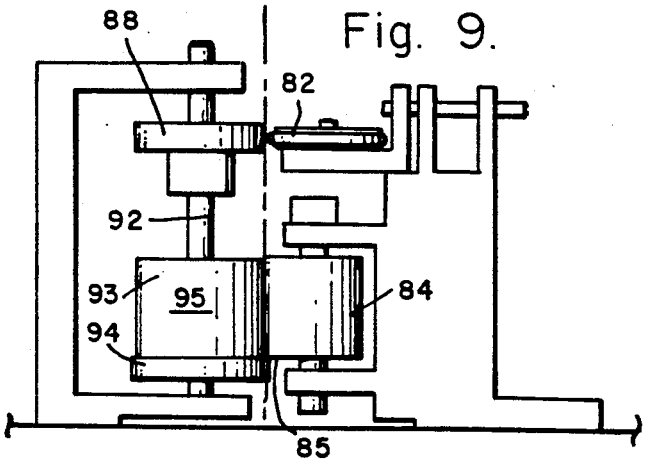
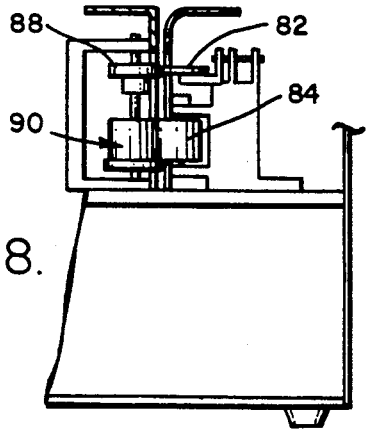
Fig. 8.

CHECK DESTRIPPER

BACKGROUND OF THE INVENTION

1. Field of the Invention

The present invention relates to apparatus which are used to orient and process checks. More particularly, the present invention relates to apparatus which are used to orient checks in a desired configuration relative to a processing station and then process the checks in a given manner.

2. Description of the Prior Art

In general, numerous check processing machines have been used throughout the history of banking. Today, checks are examined to verify accuracy of specific checks drawn against a specific bank account number. If there is a discrepancy as read by the check reading machine, the check is removed from the batch and a special encoding paper strip with the check account sequence number is affixed to the bottom of the check and generally aligned with the preprinted numbers on the check. The corroborating paper strip is affixed to the check by means such as a thin plastic strip having adhesive on one side. The thin plastic strip is of sufficient width to overlay the back of the paper corroborating strip (which may be 0.625 inch wide) as well as a widthwise section from the bottom of the check. After the processing has been completed and the correct bank account number for the check has been verified by the bank clerk, it is necessary to remove the corroborating paper strip before the processed check is returned to the party who wrote the check. In most banking operations, this destripping of the corroborating paper strip from the bottom of the check is performed by hand and is a time consuming process. The operation to destrip the paper check costs each bank approximately 45 cents per check, which can total upwards of $ 35,000 per year additional charges for even small banks. Therefore, there is a significant need to arrive at an apparatus or system for automating the process of destripping the corroborating paper strip from the bottom of the check.

In general, apparatus for Orienting checks to be aligned in a certain manner are well known in the prior art. However, the combination of orientating a check so that a portion of it can be cut in a certain manner and thereafter cutting the check at a precise location so that the original check is intact while the corroborating paper strip is removed therefrom is not known in the prior art.

SUMMARY OF THE PRESENT INVENTION

The present invention is an apparatus for orienting a check which has attached to it a corroborating paper strip in a manner such that the check and the paper strip are aligned relative to a cutting station to permit the check and the attached strip to be automatically presented to the cutting knife in a precise location such that the knife can automatically cut the check at the location of the intersection of the check edge and the edge of the corroborating paper strip and thereafter separate the two and cause the detached check to be sent to one processing station while the detached corroborating paper strip is sent to a waste paper station.

It has been discovered, according to the present invention, that if a set of wheels are oriented diagonally relative to a horizontal surface, then the diagonal wheels can cause a piece of paper such as a check to be aligned in a straight vertical manner relative to the horizontal surface in order to permit the check to be presented to a cutting station at a precise orientation so that the check can be cut along a precise location.

It has further been discovered, according to the present invention, that a check moving station can be created through the alignment of three pairs of moving wheels with each pair having an upper wheel and a lower wheel aligned with an adjacent upper and lower wheel of its pair. Further, if the central pair of wheels further comprises one lower wheel offset below its opposite lower wheel, then this pair of offset wheels can serve as a cutting knife to precisely cut the check at a desired location.

It has additionally been discovered, according to the present invention, that if a pair of aligned wheels comprises an aligned pair of upper wheels and an aligned pair of lower wheels, after a piece of paper such as a check which is passed between the pair of wheels is separated, the upper two wheels can cause one portion of the paper to be transported to one location and the lower portion of the paper to be transported to another location.

It is therefore an object of the present invention to provide an apparatus and system for efficiently destripping the corroborating paper strip from the bottom of a check after the check has been processed.

It is another object of the present invention to provide an apparatus and system for orienting a check with its corroborating paper strip attached to a cutting station at a precise location so that the knife of the cutting station can cut and separate the check from the corroborating strip at the intersection location between the check and the paper strip and cause the check to be moved to one location while the separated corroborating paper strip is moved to another location.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 6 is a rear elevational view in partial crosssection, taken along line 6—6 of FIG. 4.

FIG. 7 is a side elevational view in partial crosssection, taken along line 7—7 of FIG. 5.

FIG. 8 is a side elevational view in partial crosssection, taken along line 8—8 of FIG. 5.

FIG. 9 is an enlarged side elevational view of the cutting wheels of the present invention check destripper.

DETAILED DESCRIPTION OF THE PREFERRED EMBODIMENT

Although specific embodiments of the invention will now be described with reference the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Figure 1:
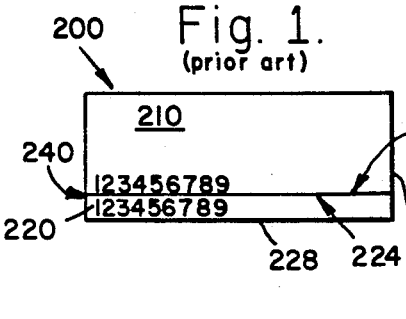
Fig. 1. (prior art)
FIG. 1 is a front elevational view of a standard bank check with the corroborating paper strip attached along the bottom of the check.
Figure 2:
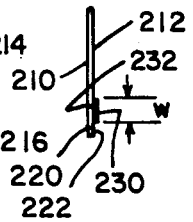
Fig. 2 (prior art
FIG. 2 is a side elevational view of a standard bank check with the corroborating paper strip attached along the bottom of the check and illustrating the adhesive strip attaching the two together.

Referring first to FIGS. 1 and 2, there is illustrated at 200 the combined paper check 210 and the corroborating paper strip 220. The check 210 and corroborating paper strip 220 are attached together through an adhesive strip 230 which contains adhesive on its interior face 232. The width "W" of adhesive strip 230 is sufficient to cover a portion of the back 212 of check 210 and the back 222 of corroborating paper strip 220. The lower edge 214 of check 210 adjoins the upper edge 224 of corroborating paper strip 220 and creates a line of joinder 240. The present invention check destripper seeks to cut the combined check and corroborating paper strip 200 along the line of joinder 240 and cause the check 210 to be directed to one location and the corroborating paper strip 220 to be directed to a second location.

Figure 3:
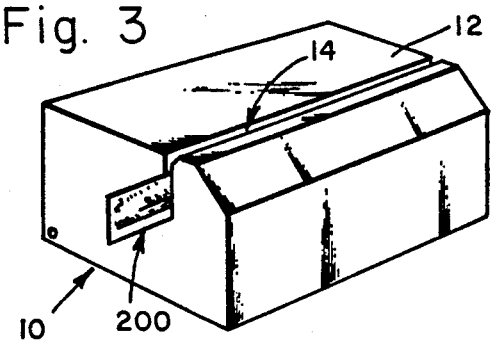
FIG. 3 is a perspective view of the present invention check destripper with the cover in place.

A perspective view of the present invention check destripper 10 is illustrated in FIG. 3, showing the outer cover 12 in place. The outer cover 12 essentially is a solid piece of material except for an opening 14 into which the combined check and corroborating paper strip 200 is inserted as illustrated in FIG. 3. While the horizontal insertion as illustrated in FIG. 3 is the preferred insertion orientation, the present invention permits the combination 200 to be inserted through the top of opening 14 and properly oriented before being cut.

Figure 4:
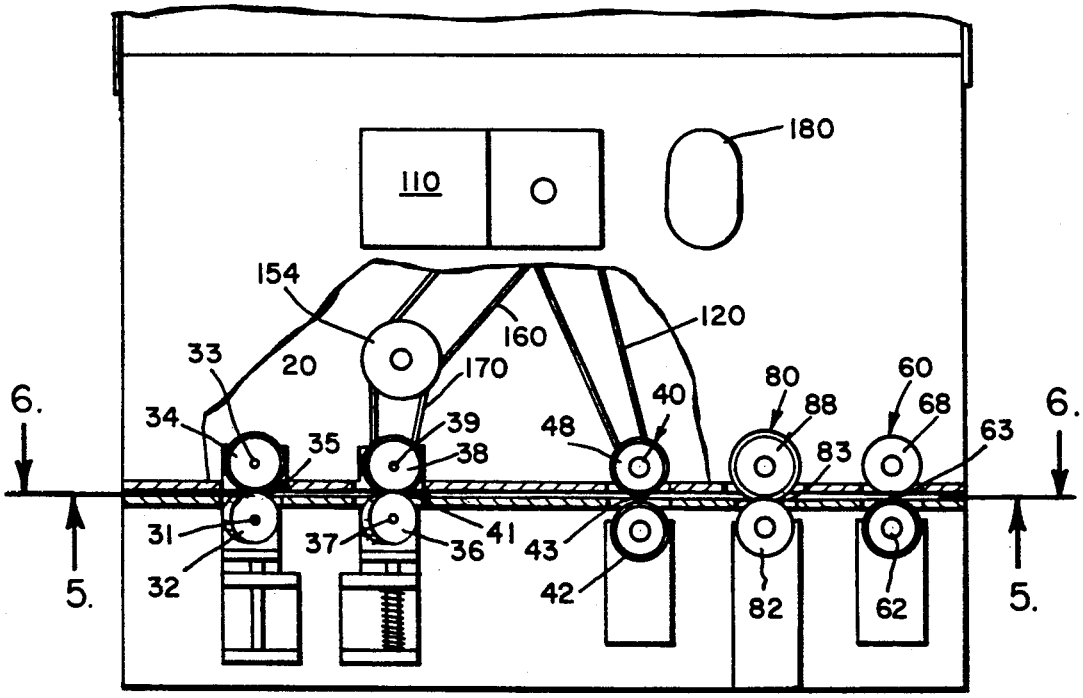
FIG. 4 is a top plan view of the present invention check destripper with the cover removed and with a portion of the plate broken away part of the pulley system.
Figure 5:
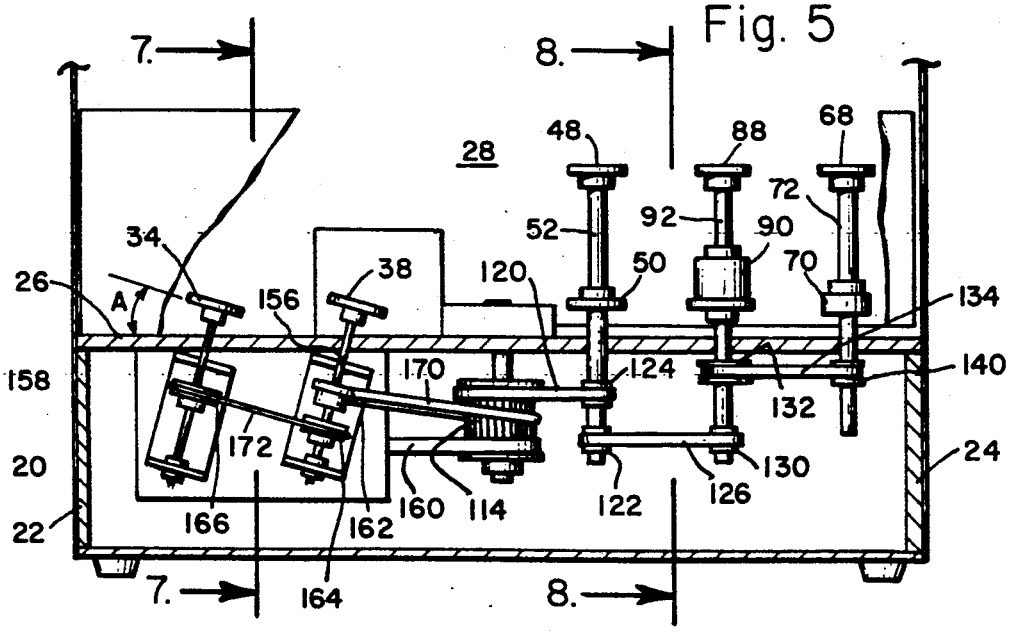
FIG. 5 is a front elevational view in partial crosssection, taken along line 5—5 of FIG. 4.

The major operating apparatus of the present invention check destripper 10 is illustrated in FIGS. 4 and 5. The check destripper comprises a body 20 having sidewalls 22 and 24. The body 20 has a horizontal platform 30 supported by sidewalls 22 and 24 to divide the body into an upper compartment 28 and a lower compartment 30. The upper compartment 28 houses the operating stations and the lower compartment 30 houses the belt and pulley systems which drives the wheels of the operating stations. The operating stations are the essential feature of the present invention. It will be appreciated that the belt and pulley system illustrated is but one of many standard systems which can be used to drive the operating wheels for the desired result.

The present invention check destripper 10 essentially embodies two primary operating stations; a first operating station which orients the check with corroborating paper strip attached and a second operating station which precisely cuts the check at the intersection of the edge of the check and the corroborating paper strip. The first operating station 20 comprises two pairs of wheels which are in the upper compartment 28 and set at a downward angle to the horizontal platform 26. Viewed from the top view of FIG. 4, the first pair of wheels comprises first angular wheel 32, and second angular wheel 34. The two angular wheels 32 and 34 are aligned parallel to each other and touch each other at a point of contract designated as 35. Viewed from above, first angular wheel 32 rotates in the clockwise direction and second angular wheel 34 rotates in the counterclockwise direction. The second pair of wheels comprises third angular wheel 36, and fourth angular wheel 38. The two angular wheels 36 and 38 are aligned parallel to each other and touch each other at a point of contact designated as 41. Viewed from above, third angular wheel 36 rotates in the clockwise direction and fourth angular wheel 38 rotates in the counterclockwise direction. The center 31 of first angular wheel 32 is aligned with the center 37 of third angular wheel 36. The center 33 of second angular wheel 34 is aligned with the center 39 of fourth angular wheel 38. The angle of each wheel 32, 34, 36 and 38 to the horizontal platform 26 is the same. The angle A (see FIG. 5) can range from approximately 15 degrees to approximately 20 degrees. As will be described later on, second wheel 34 is a driven wheel and serves to drive first wheel 32. Also, fourth wheel 38 is a driven wheel and serves to drive third wheel 36. The purpose of the four wheels is to create a check orienting station to cause the combination check and corroborating paper strip 200 to be horizontally aligned as it leaves the orienting station. The combination check and corroborating paper strip 200 can be deposited into the check destripper 10 through opening 14 and as long as leading edge 216 of the combination 200 is not placed parallel to the horizontal platform 26, the first pair of wheels 32 and 34 will grab the combination 200 and as it passes between the two wheels at their point of contact 35, will begin to orient it such that the bottom edge 228 of corroborating paper strip 220 lies flush against horizontal platform 26. The second set of angular wheels 36 and 38 will complete the orientation as combination 200 passes between angular wheels 36 and 38 at point 41. The two sets of wheels with each pair rotating in the opposite direction as previously described serves to pull the combination 200 along the length of the check destripper 200 and horizontally orient the combination 200. Therefore, as the combination check and corroborating paper strip 200 leaves the four angular wheels of the orienting station, the lower edge 228 of corroborating paper strip 220 is horizontal and rests against horizontal platform 26.

The combination check and corroborating paper strip 200 is then passed to the cutting station. Referring to FIGS. 4, 5 and 6, the cutting station comprises three sets of pairs of wheels. The first cutting station pair of wheels 40 comprises first upper wheel 42 and first lower wheel 44 which are aligned parallel to each other on the same shaft 46; and second upper wheel 48 and second lower wheel 50 aligned parallel to each other on the same shaft 52. All of the wheels are horizontally aligned and are parallel to horizontal platform 26. First upper wheel 42 is parallel with second upper wheel 48 and the two touch each other at a point of contact 43. First lower wheel 44 is parallel with second lower wheel 50 and the two touch each other at a point of contact. At the end of the cutting station is a third pair of wheels which are similar to the first set of cutting station pair of wheels. The third cutting station pair of wheels 60 comprises fifth upper wheel 62 and fifth lower wheel 64 which are aligned parallel to each other on the same shaft 66; and sixth upper wheel 68 and sixth lower wheel 70 aligned parallel to each other on the same shaft 72. All of the wheels are horizontally aligned and are parallel to horizontal platform 26. Fifth upper wheel 62 is parallel with sixth upper wheel 68 and the two touch each other at a point of contact 63. Fifth lower wheel 64 is parallel with sixth lower wheel 70 and the two touch each other at a point of contact. In the preferred embodiment, the wheels of the first cutting station set of wheels are parallel to the wheels of the third cutting station pair of wheels. Therefore, wheels 42 and 62 are parallel; wheels 48 and 68 are parallel; wheels 44 and 64 are parallel; and wheels 50 and 70 are parallel.

Between the first and third pairs of cutting station wheels is a second pair of wheels which comprise the cutting knife. The cutting wheels of the cutting station pair of wheels 80 comprises third upper wheel 82 and third lower wheel 84 which are aligned parallel to each other but on separate shafts with wheel 82 on shaft 86 and wheel 84 on shaft 87; and fourth upper wheel 88 and fourth lower wheel 90 aligned parallel to each other on the same shaft 92. Wheels 82 and 84 are on separate shafts so that the normal pressure on wheels 88 and 90 can be adjusted separately. This is important for proper cutting of the combination check and corroborating paper strip. All of the wheels are horizontally aligned and are parallel to horizontal platform 26. Third upper wheel 82 is parallel with fourth upper wheel 88 and the two touch each other at a point of contact 83. The third and fourth lower wheels are the cutting wheels. The cutting wheels are shown in greater detail in FIG. 9. Fourth lower cutting wheel 90 is formed in two sections, an upper section 93 and a lower section 94. The diameter of lower section 94 is greater than the diameter of upper section 93. The upper section 93 is aligned parallel to third lower cutting wheel and they are approximately the same height. The lower circumference 85 of third lower cutting wheel 84 slightly overlaps the outer upper surface 95 of lower section 94. Therefore, as a piece of paper is caused to pass between the third and fourth cutting wheels, the area between the lower circumference 85 of third lower cutting wheel 84 and the upper surface 95 of second section 94 of fourth lower cutting wheel 92 acts as a knife and serves to cut the section of paper which passes along this intersection.

The first, third and fifth pairs of wheels rotate in the clockwise direction while the second, fourth and sixth pairs of wheels rotate in the counterclockwise direction. As will be described below, the second, fourth and sixth pairs of wheels are driven wheels and they drive the first, third and fifth pairs of wheels respectively. In this manner, the paper is caused to move from left to right (as viewed from FIGS. 4 and 5).

Once the paper is cut, the upper wheels 82, 62, 88 and 68 serve to guide the upper section of paper in one direction while the lower wheels 64 and 70 serve to guide the lower section of paper in another direction. The cutting station wheels are configured such that most of the lower wheels 44, 64, 50, 90 and 70 will touch the corroborating paper strip 220 while the upper wheels 42, 82, 62, 48, 88 and 68 will touch the check 210. The intersection of the lower circumference 85 of third lower cutting wheel 84 and the outer upper surface 95 of lower section 94 of fourth lower cutting wheel 90 which acts as the knife is aligned with the line of joinder 240 between check 210 and corroborating paper strip 220. Therefore, when the combination check and corroborating paper strip 200 is fed into the present invention check destripper 10, the first operating station 20 serves to orient the combination paper 200 in a horizontal direction such that lower edge 228 is flush with the upper surface of platform 26 and the combination 200 is fed into the cutting station where the upper wheels guide the check 210 while the lower wheels guide the corroborating paper strip 220. After the combination 200 passes through the third and fourth set of wheels and is cut along the line of joinder 240 as previously described, the fifth and sixth pairs of wheels guide the separated sections. Upper wheels 60 and 62 guide the check portion 210 to one location such as a check sorter or collection receptacle from which the checks are distributed to the proper processing station while the lower wheels 64 and 70 guide the used corroborating paper strip 220 to a waste receptacle.

Therefore, through use of the present invention, the combination check and corroborating paper strip 200 can be quickly and efficiently and automatically proceed to separate the check 210 from its corroborating paper strip 220 after the corroborating paper strip 220 has served its check verification purpose, and further provides a system for routing the check 210 to one station for further processing while the used corroborating paper strip 220 is discarded. The apparatus permits the combination to be quickly and efficiently placed in the machine since the orientation station with aligned wheels will properly orient the combination as long as the check is inserted in a manner other than completely perpendicular to the orientation station wheels. This saves a lot of time and effort since it is not necessary to precisely align a combination in a completely horizontal manner before it is fed into the check destripper 10.

All of the wheels are caused to rotate in the manner described above by a conventional motor and pulley system. One preferred motor and pulley system as illustrated will now be described. It will be appreciated that any conventional system which causes one set of wheels to rotate in the clockwise direction and the other set of wheels to rotate in the counterclockwise direction to move the combination 200 from left to right as viewed from FIGS. 4 and 5 can be incorporated with the present invention check destripper 10. The check destripper 10 is driven by a 1/100 horsepower −100 RPM motor 110. Shaft 112 supports a toothed pulley 114 which contains 48 teeth. Two belts are wound on the toothed pulley 114. A first belt 120 is wound on an upper toothed pulley 124 which is supported on shaft 52. A lower toothed pulley 122 is also supported on shaft 52. A second belt 126 connects lower toothed pulley 122 to lower toothed pulley 130 supported on shaft 92. An upper toothed pulley 132 is also supported on shaft 92. A third belt 134 connects upper toothed pulley 132 to toothed pulley 140 supported on shaft 72. Toothed pulleys 122, 124 and 130 can each be 24 toothed pulleys. Toothed pulley 132 can be a 60 toothed pulley. Toothed pulley 140 can be a 16 toothed pulley. As a result, the first, second, third and fourth pairs of wheels can be driven at the same speed. The larger toothed pulley 132 relative to the smaller toothed pulley 140 causes shaft 72 and therefore the fifth and sixth pairs of wheels to be driven 4 times faster than the first through fourth pulleys, thereby causing the separated check 210 to be driven or shot out of the check destripper 10 by the fifth and sixth pairs of wheels.

Referring to FIG. 7, a standby shaft 150 supports a toothed pulley 152 and a grooved pulley 154. The second belt 160 wound on toothed pulleY 114 is also wound on toothed pulley 152. Toothed pulley 152 is also a 24 toothed pulley. Orientation angular wheel 38 is supported on shaft 156. Orientation angular wheel 34 is supported on shaft 158. Shaft 156 supports upper grooved pulley 162 and lower grooved pulley 164. Shaft 158 supports grooved pulley 166. A first round belt 170 connects grooved pulleys 154 and 162. A second round belt 172 connects grooved pulleys 164 and 166. Therefore, wheels 34 and 38 are driven by the motor and pulley system while wheels 32 and 36 are driven by wheels 34 and 38 respectively. It will be appreciated that other pulley arrangements to achieve the same result are within the spirit and scope of the present invention.

A capacitor 180 which can be a 4 microfarad capacitor is connected to motor 110.

Therefore, through the pulley and belt system described above, the motor causes wheels 34, 38, 48, 88, 68, 50, 90, and 70 to be driven in the counterclockwise direction. Each of these wheels causes its parallel adjacent wheel to be driven in the clockwise direction. Wheel 34 drives wheel 32 in the clockwise direction. Wheel 38 drives wheel 36 in the clockwise direction, Wheel 48 drives wheel 42 in the clockwise direction. Wheel 50 drives wheel 44 in the clockwise direction. Wheel 88 drives wheel 82 in the clockwise direction. Wheel 90 drives wheel 84 in the clockwise direction. Wheel 68 drives wheel 62 in the clockwise direction. Wheel 70 drives wheel 64 in the clockwise direction.

Defined more broadly, the present invention is an apparatus for separating a check which has attached to it a corroborating paper strip in a manner such that the corroborating paper strip is aligned along the bottom edge of the check and the two are attached together by means which creates a line of joinder between the lower edge of the check and the upper edge of the corroborating paper strip, comprising:

a. an opening in said apparatus through which said check and attached corroborating paper strip is inserted;

b. a horizontally aligned plate;

c. means for orienting the check and attached corroborating paper strip such that the bottom edge of the corroborating paper strip is adjacent said plate, and the check and corroborating paper strip are approximately perpendicular to said plate; and d. means for separating said check and corroborating paper strip along said line of joinder and causing said separated check to be transported to a first location and causing said separated corroborating paper stript to be transported to a second location.

The means for orienting said check and attached corroborating paper strip further comprises:

a. a first pair of wheels which are parallel to each other and touch each other at an adjoining point along their respective circumferences, the pair of wheels aligned at an angle relative to said plate, and caused to rotate such that one wheel rotates in the clockwise direction while the other wheel rotates in the counterclockwise direction; and b. a second pair of wheels which are parallel to each other and touch each other at an adjoining point along their respective circumferences, the pair of wheels aligned at an angle relative to said plate and separated from said first pair of wheels by a horizontal gap, and caused to rotate such that one wheel rotates in the clockwise direction while the other wheel rotates in the counterclockwise direction;

c. whereby when said combination check and attached corroborating paper strip is inserted into said apparatus through said opening, said first pair of wheels pulls said check and attached corroborating paper strip into said apparatus by causing said check and attached corroborating paper strip to be guided between said first pair of wheels along their point of touching and pulled toward said plate with the leading edge of said corroborating paper strip being pulled toward said plate and said second pair of wheels continues the process of pulling said check and attached corroborating paper strip toward said plate to orient the lower edge of the attached paper strip along the surface of said plate and cause said check and attached paper strip to be aligned approximately perpendicular to said plate.

The angle of said first pair of wheels relative to said plate is approximately between 15 degrees and 20 degrees and the angle of said second pair of wheels relative to said plate is approximately between 15 degrees and 20 degrees.

The means for separating said check and corroborating paper strip further comprises:

a. a first set of wheels further comprising, (i) a pair of upper wheels which are parallel to each other and touch each other at an adjoining point along their respective circumferences, the pair of wheels aligned parallel relative to said plate, and caused to rotate such that one wheel rotates in the clockwise direction while the other wheel rotates in the counterclockwise direction, (ii) a pair of lower wheels separated from said pair of upper wheels by a vertical gap, with a respective one wheel from said pair of upper wheels and one wheel from said pair of lower wheels being supported on the same shaft, the pair of lower wheels also parallel to each other and touching each other at an adjoining point along their respective circumferences, the pair of wheels aligned parallel relative to said plate, and caused to rotate such that one wheel rotates in the clockwise direction while the other wheel rotates in the counterclockwise direction;

b. a second set of wheels separated from said first set of wheels by a horizontal gap, and further comprising, (i) a pair of upper wheels which are parallel to each other and touch each other at an adjoining point along their respective circumferences, the pair of wheels aligned parallel relative to said plate, and caused to rotate such that one wheel rotates in the clockwise direction while the other wheel rotates in the counterclockwise direction, (ii) a pair of lower wheels separated from said pair of upper wheels by a vertical gap, one of the lower wheels having two sections and one of the lower wheels have one section, with an upper wheel and the lower wheel having two sections supported on one shaft while the other upper wheel and the lower wheel having one section are supported on two separate shafts, the pair of lower wheels also parallel to each other and touching each other at an adjoining point along their respective circumferences, the pair of wheels aligned parallel relative to said plate, and caused to rotate such that one wheel rotates in the clockwise direction while the other wheel rotates in the counterclockwise direction, (iii) the lower wheel having two sections including an upper section of smaller diameter than the lower section aligned relative to the other lower wheel having one section such that the upper surface of the lower section of the two section wheel comes in contact with the lower circumference of the other lower wheel having one section to thereby create a knife which can cut the check and attached corroborating paper strip at the location of the point of touching of the two wheels;

c. a third set of wheels separated from said second set of wheels by a horizontal gap, and further comprising, (i) a pair of upper wheels which are parallel to each other and touch each other at an adjoining point along their respective circumferences, the pair of wheels aligned parallel relative to said plate, and caused to rotate such that one wheel rotates in the clockwise direction while the other wheel rotates in the counterclockwise direction, (ii) a pair of lower wheels separated from said pair of upper wheels by a vertical gap, with a respective one wheel from said pair of upper wheels and one wheel from said pair of lower wheels being supported on the same shaft, the pair of lower wheels also parallel to each other and touching each other at an adjoining point along their respective circumferences, the pair of wheels aligned parallel relative to said plate, and caused to rotate such that one wheel rotates in the clockwise direction while the other wheel rotates in the counterclockwise direction; and d. the three sets of wheels aligned relative to said means for orienting said check and attached paper strip such that each of the upper pair of wheels comes in contact with said check along the point of touching between each pair of upper wheels and each of the lower pair of wheels comes in contact with said corroborating paper strip along the point of touching between each pair of lower wheels;

e. whereby when said check and attached corroborating paper strip leaves said leads for orienting the check and attached corroborating paper strip, said first set of wheels pulls the check and attached corroborating paper strip horizontally between the pair of wheels and guides it to the second pair of wheels, the upper pair of wheels of the second pair of wheels pulls the check and corroborating paper strip such that the lower of pair wheels cuts the check and corroborating paper strip along their line of joinder, and the separated check and corroborating paper strip are guided to the third pair of wheels wherein the upper pair of wheels causes the separated check to be guided to one location outside the apparatus while the lower pair of wheels causes the separated corroborating paper strip to be guided to a second location outside the apparatus.

The third pair of wheels are caused to rotate faster than said second pair of wheels such that said separated check and separated corroborating paper strip are forcefully ejected from said apparatus.

Of course the present invention is not intended to be restricted to any particular form or arrangement, or any specific embodiment disclosed herein, or any specific use, since the same may be modified in various particulars pr relations without departing from the spirit or scope of the claimed invention hereinabove shown and described of which the apparatus shown is intended only for illustration and for disclosure of an operative embodiment and not to show all of the various forms or modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What is claimed is:

1. An apparatus for separating a check which has attached to it a corroborating paper strip in a manner such that the corroborating paper strip is aligned along the bottom edge of the check and the two are attached together by means which creates a line of joinder between the lower edge of the check and the upper edge of the corroborating paper strip, comprising:

a. an opening in said apparatus through which said check and attached corroborating paper strip is inserted;

b. a horizontally aligned plate;

c. means for orienting the check and attached corroborating paper strip such that the bottom edge of the corroborating paper strip is adjacent said plate, and the check and corroborating paper strip are approximately perpendicular to said plate, further comprising, (i) a first pair of wheels which are parallel to each other and touch each other at an adjoining point along their respective circumferences, the pair of wheels aligned at an angle relative to said plate, and caused to rotate such that one wheel rotates in the clockwise direction while the other wheel rotates in the counterclockwise direction, (ii) a second pair of wheels which are parallel to each other and touch each other at an adjoining point along their respective circumferences, the pair of wheels aligned at an angle relative to said plate and separated from said first set of wheels by a horizontal gap, and caused to rotate such that one wheel rotates in the clockwise direction while the other wheel rotates in the counterclockwise direction;

d. means for separating said check and corroborating paper strip along said line of joinder and causing said separated check to be transported to a first location and causing said separated corroborating paper strip to be transported to a second location, further comprising, (i) a first set of wheels including, (a) a pair of upper wheels which are parallel to each other and touch each other at an adjoining point along their respective circumferences, the pair of wheels aligned parallel relative to said plate, and caused to rotate such that one wheel rotates in the clockwise direction while the other wheel rotates in the counterclockwise direction, (b) a pair of lower wheels separated from said pair of upper wheels by a vertical gap, with a respective one wheel from said pair of upper wheels and one wheel from said pair of lower wheels being supported on the same shaft, the pair of lower wheels which also parallel to each other and touching each other at an adjoining point along their respective circumferences, the pair of wheels aligned parallel relative to said plate, and caused to rotate such that one wheel rotates in the clockwise direction while the other wheel rotates in the counterclockwise direction, (ii) a second set of wheels separated from said first set of wheels by a horizontal gap, including, (a) a pair of upper wheels which are parallel to each other and touch each other at an adjoining point along their respective circumferences, the pair of wheels aligned parallel relative to said plate, and caused to rotate such that one wheel rotates in the clockwise direction while the other wheel rotates in the counterclockwise direction, (b) a pair of lower wheels separated from said pair of upper wheels by a vertical gap, one of the lower wheels having two sections and one of the lower wheels have one section, with an upper wheel and the lower wheel having two sections supported on one shaft while the other upper wheel and the lower wheel having one section are supported on two separate shafts, the pair of lower wheels also parallel to each other and touching each other at an adjoining point along their respective circumferences, the pair of wheels aligned parallel relative to said plate, and caused to rotate such that one wheel rotates in the clockwise direction while the other wheel rotates in the counterclockwise direction, (c) the lower wheel having two sections including an upper section of smaller diameter than the lower section aligned relative to the other lower wheel having one section such that the upper surface of the lower section of the two section wheel comes in contact with the lower circumference of the other lower wheel having one section to thereby create a knife which can cut the check and attached corroborating paper strip at the location of the point of touching of the two wheels;

(b) a pair of lower wheels separated from said pair of upper wheels by a vertical gap, with a respective one wheel from said pair of upper wheels and one wheel from said pair of lower wheels being supported on the same shaft, the pair of lower wheels also parallel to each other and touching each other at an adjoining point along their respective circumferences, the pair of wheels aligned parallel relative to said plate, and caused to rotate such that one wheel rotates in the clockwise direction while the other wheel rotates in the counterclockwise direction, (c) one of said pair of lower wheels having two sections, with an upper section of smaller diameter than the lower section and aligned relative to the other lower wheel such that the upper surface of the lower section comes in contact with the lower circumference of the other lower wheel to thereby create a knife which can cut the check and attached corroborating paper strip at the location of the point of joinder of the two wheels;

(iii) a third set of wheels separated from said first set of wheels by a horizontal gap, including, (a) a pair of upper wheels which are parallel to each other and touch each other at an adjoining point along their respective circumferences, the pair of wheels aligned parallel relative to said plate, and caused to rotate such that one wheel rotates in the clockwise direction while the other wheel rotates in the counterclockwise direction, (b) a pair of lower wheels separated from said pair of upper wheels by a vertical gap, with a respective one wheel from said pair of upper wheels and one wheel from said pair of lower wheels being supported on the same shaft, the pair of lower wheels also parallel to each other and touching each other at an adjoining point along their respective circumferences, the pair of wheels aligned parallel relative to said plate, and caused to rotate such that one wheel rotates in the clockwise direction while the other wheel rotates in the counterclockwise direction; and d. the three sets of wheels in means for separating said check and corroborating paper strip aligned relative to said first and second pair of wheels of said means for orienting said check and attached paper strip such that each of the upper pair of wheels comes in contact with said check along the point of touching between each pair of upper wheels and each of the lower pair of wheels comes in contact with said corroborating paper strip along the point of touching between each pair of lower wheels;

e. whereby when said combination check and attached corroborating paper strip is inserted into said apparatus through said opening, said first pair of wheels pulls said check and attached corroborating paper strip into said apparatus by causing said check and attached corroborating paper strip to be guided between said first pair of wheels along their point of joinder and pulled toward said plate with the leading edge of said corroborating paper strip being pulled toward said plate and said second pair of wheels continues the process of pulling said check and attached corroborating paper strip toward said plate to orient the lower edge of the attached paper strip along the surface of said plate and cause said check and attached paper strip to be aligned perpendicular to said plate, and when said check and attached corroborating paper strip leaves the second pair wheels of said means for orienting the check and attached corroborating paper strip, said first set of wheels pulls the check and attached corroborating paper strip horizontally between the pair of wheels and guides, it to the second pair of wheels, the upper pair of wheels of the second pair of wheels pulls the check and corroborating paper strip such that the lower pair wheels cuts the check and corroborating paper strip along their line of joinder, and the separated check and corroborating paper strip are guided to the third pair of wheels wherein the upper pair of wheels causes the separated check to be guided to one location outside the apparatus while the lower pair of wheels causes the separated corroborating paper strip to be guided to a second location outside the apparatus.

2. An apparatus for separating a check which has attached to it a corroborating paper strip in a manner such that the corroborating paper strip is aligned along the bottom edge of the check and the two are attached together by means which creates a line of joinder between the lower edge of the check and the upper edge of the corroborating paper strip, comprising:

a. an opening in said apparatus through which said check and attached corroborating paper strip is inserted;

b. a horizontally aligned plate;

c. means for orienting the check and attached corroborating paper strip such that the bottom edge of the corroborating paper strip is adjacent said plate, and the check and corroborating paper strip are approximately perpendicular to said plate;

d. means for separating said check and corroborating paper strip along said line of joinder and causing said separated check to be transported to a first location and causing said separated corroborating paper strip to be transported to a second location; and e. said means for separating said check and corroborating paper strip further comprises, (i) a first set of wheels further comprising, (aa) a pair of upper wheels which are parallel to each other and touch each other at an adjoining point along their respective circumferences, the pair of wheels aligned parallel relative to said plate, and caused to rotate such that one wheel rotates in the clockwise direction while the other wheel rotates in the counterclockwise direction.

(bb) a pair of lower wheels separated from said pair of upper wheels by a vertical gap, with a respective one wheel from said pair of upper wheels and one wheel from said pair of lower wheels being supported on the same shaft, the pair of lower wheels also parallel to each other and touching each other at an adjoining point along their respective circumferences, the pair of wheels aligned parallel relative to said plate, and caused to rotate such that one wheel rotates in the clockwise direction while the other wheel rotates in the counterclockwise direction, (ii) a second set of wheels separated from said first set of wheels by a horizontal gap, and further comprising, (aa) a pair of upper wheels which are parallel to each other and touch each other at an adjoining point along their respective circumferences, the pair of wheels aligned parallel relative to said plate, and caused to rotate such that one wheel rotates in the clockwise direction while the other wheel rotates in the counterclockwise direction, (bb) a pair of lower wheels separated from said pair of upper wheels by a vertical gap, one of the lower wheels having two sections and one of the lower wheels have one section, with an upper wheel and the lower wheel having two sections supported on one shaft while the other upper wheel and the lower wheel having one section are supported on two separate shafts, the pair of lower wheels also parallel to each other and touching each other at an adjoining point along their respective circumferences, the pair of wheels aligned parallel relative to said plate, and caused to rotate such that one wheel rotates in the clockwise direction while the other wheel rotates in the counterclockwise direction, (cc) the lower wheel having two sections including an upper section of smaller diameter than the lower section aligned relative to the other lower wheel having one section such that the upper surface of the lower section of the two section wheel comes in contact with the lower circumference of the other lower wheel having one section to thereby create a knife which can cut the check and attached corroborating paper strip at the location of the point of touching of the two wheels, (iii) a third set of wheels separated from said second set of wheels by a horizontal gap, and further comprising, (aa) a pair of upper wheels which are parallel to each other and touch each other at an adjoining point along their respective circumferences, the pair of wheels aligned parallel relative to said plate, and caused to rotate such that one wheel rotates in the clockwise direction while the other wheel rotates in the counterclockwise direction, (bb) a pair of lower wheels separated from said pair of upper wheels by a vertical gap, with a respective one wheel from said pair of upper wheels and one wheel from said pair of lower wheels being supported on the same shaft, the pair of lower wheels also parallel to each other and touching each other at an adjoining point along their respective circumferences, the pair of wheels aligned parallel relative to said plate, and caused to rotate such that one wheel rotates in the clockwise direction while the other wheel rotates in the counterclockwise direction, and (iv) the three sets of wheels aligned relative to said means for orienting said check and attached paper strip such that each of the upper pair of wheels comes in contact with said check along the point of touching between each pair of upper wheels and each of the lower pair of wheels comes in contact with said corroborating paper strip along the point of touching between each pair of lower wheels;

f. whereby when said check and attached corroborating paper strip leaves said leads for orienting the check and attached corroborating paper strip, said first set of wheels pulls the check and attached corroborating paper strip horizontally between the pair of wheels and guides it to the second pair of wheels, the upper pair of wheels of the second pair of wheels pulls the check and corroborating paper strip such that the lower of pair wheels cuts the check and corroborating paper strip along their line of joinder, and the separated check and corroborating paper strip are guided to the third pair of wheels wherein the upper pair of wheels causes the separated check to be guided to one location outside the apparatus while the lower pair of wheels causes the separated corroborating paper strip to be guided to a second location outside the apparatus.

3. An apparatus in accordance with claim 2 wherein said third pair of wheels are caused to rotate faster than said second pair of wheels such that said separated check and separated corroborating paper strip are forcefully ejected from said apparatus.

* * * * *